US006739666B2

(12) United States Patent
Alampi

(10) Patent No.: US 6,739,666 B2
(45) Date of Patent: May 25, 2004

(54) CHAIR WITH ADVANCEABLE SEAT

(75) Inventor: Ugo Alampi, Desio (IT)

(73) Assignee: Compas S.r.l., Desio (IT)

( * ) Notice: Subject to any disclaimer, the term of this patent is extended or adjusted under 35 U.S.C. 154(b) by 0 days.

(21) Appl. No.: 10/216,841

(22) Filed: Aug. 13, 2002

(65) Prior Publication Data

US 2003/0189369 A1 Oct. 9, 2003

(30) Foreign Application Priority Data

Apr. 3, 2002 (IT) ..... MI2002A0690

(51) Int. Cl.[7] ..... A47C 1/023
(52) U.S. Cl. ..... 297/337; 297/313; 297/329
(58) Field of Search ..... 297/313, 325, 297/329, 337

(56) References Cited

U.S. PATENT DOCUMENTS

| | | | | | |
|---|---|---|---|---|---|
| 3,982,785 | A | * | 9/1976 | Ambasz | 297/337 |
| 5,035,466 | A | * | 7/1991 | Mathews et al. | 297/337 |
| 5,755,488 | A | * | 5/1998 | Beda et al. | 297/337 |
| 5,782,536 | A | * | 7/1998 | Heidmann et al. | 297/440.15 |
| 6,027,168 | A | * | 2/2000 | Crossman et al. | 297/337 |
| 6,135,556 | A | * | 10/2000 | Chu et al. | 297/337 |
| 6,193,313 | B1 | * | 2/2001 | Jonsson | 297/284.1 |
| 6,513,222 | B2 | * | 2/2003 | Von Ehr et al. | 297/337 |

* cited by examiner

*Primary Examiner*—Peter R. Brown
(74) *Attorney, Agent, or Firm*—Young & Thompson

(57) ABSTRACT

The chair comprises, for its support on the floor, a structure (16, 12) carrying a seat and a back-rest. The chair is provided with a mechanism (10) which enables the seat to be advanced relative to the back-rest, within a predetermined range.

9 Claims, 2 Drawing Sheets

CHAIR WITH ADVANCEABLE SEAT

FIELD OF THE INVENTION

The present invention relates to chairs in general, and to office chairs in particular.

BACKGROUND OF THE INVENTION

Chairs are known to comprise, for their support on the floor, a structure carrying a seat and a back-rest. The position of their seat relative to their back-rest is fixed in the direction from the rear to the front.

The inventor of the present invention has realized that it would be very useful to conceive a chair in which the seat can be advanced relative to the back-rest in said rear-front direction (hereinafter known as the advancement direction) within a predetermined range, starting from an initial withdrawn position. It has in fact been verified that this enables greater comfort to be offered to the user, in addition to enabling the position of the seat relative to the back-rest to be adapted to the specific physical characteristics of the user, so that this latter can assume a more correct posture.

It should be noted that in the present case an inventive level is recognizable in the first place from the fact of having become aware of this requirement, i.e. of having posed the problem.

SUMMARY OF THE INVENTION

The object of the present invention is therefore to provide a chair in which the seat can be made to advance relative to the back-rest. This object is attained by the chair according to the present invention, characterised by being provided with a mechanism which enables the seat to be advanced relative to the back-rest, within a predetermined range.

Specifically, this mechanism comprises:

- a connecting rod means which connects the rear of the seat to the support structure, the connecting rod means operating in a vertical plane parallel to the advancement direction;
- an intermediate element disposed between the seat and the support structure, and which at its rear also carries the back-rest;
- guide means which enable the seat to be moved in the two senses along the advancement direction, relative to the intermediate element;
- a cylindrical hinge means with its axis horizontal and perpendicular to the advancement direction, which secures the intermediate element to the front part of the support structure;
- a rearward-located elastic means which tends to withdraw the intermediate element from the support structure.

A user sitting on a chair provided with the mechanism, the essential characteristics of which are described above, can comfortably adjust the advancement position of the seat relative to the back-rest by simply pressing against the back-rest with his or her body, until the seat assumes the desired advancement position. To maintain the advancement position reached by the seat in this manner, the user has merely to abstain from further pressing his or her body against the back-rest.

From the aforegoing description of the characteristics of said mechanism, it will be apparent that as the back-rest is carried by the intermediate element, when this latter rotates about the said hinge means, the back-rest also undergoes an identical rotation about the same hinge means, without however undergoing translational movement.

Preferably, in order to achieve greater solidity of the advancement mechanism and a better force distribution, the said connecting rod means comprise a pair of parallel, spaced-apart connecting rods, the corresponding end hinges of which are coaxial.

The aforesaid elastic element is conveniently a helical spring. Preferably, elastic means are provided to automatically return the seat into its most withdrawn position when the chair is unoccupied by the user.

BRIEF DESCRIPTION OF THE DRAWINGS

The invention will be more apparent from the following description of one embodiment thereof. In this description, reference is made to the accompanying drawings, in which.

DETAILED DESCRIPTION OF THE INVENTION

Figure 1:
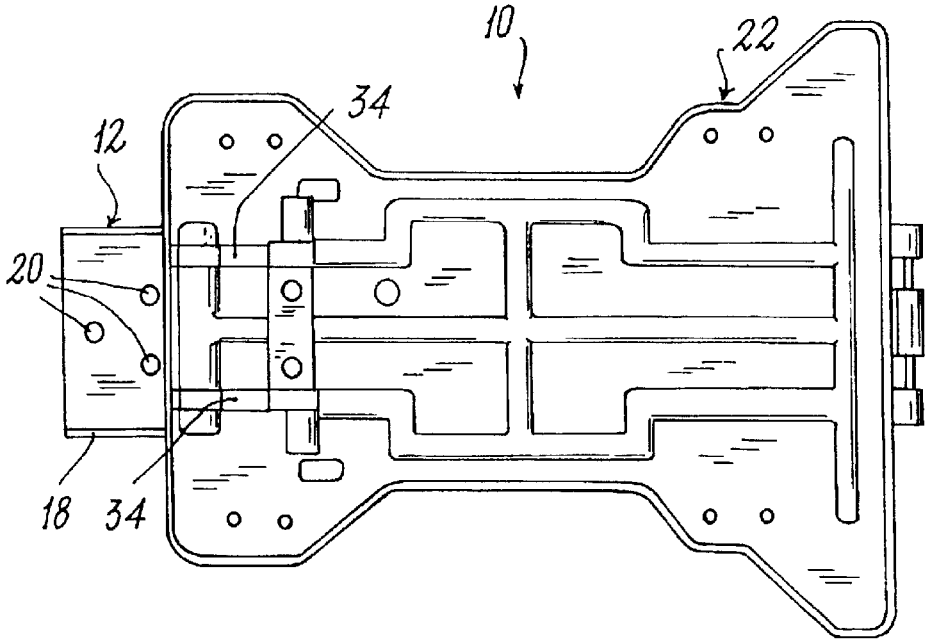
FIG. 1 is a plan view from above of a mechanism according to the present invention, in this specific case of the type suitable for an office chair.
Figure 2:
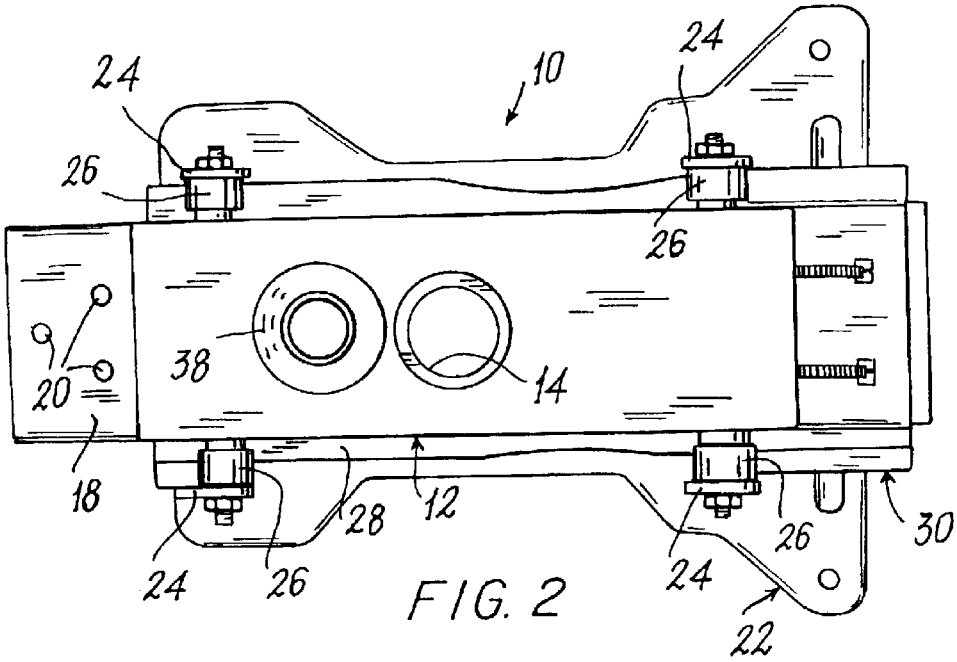
FIG. 2 is a plan view thereof from below.

As can be seen from the figures, the mechanism 10 shown therein is of the type for an office chair in this specific case. In this respect., this mechanism comprises a so-called conical connector support, indicated overall by 12, which comprises a conical cavity 14 into which the upper end of a conventional circular column 16 for an office chair is inserted, from its lower end there equidistantly extending five usual radial legs (not shown) provided at their far ends with castors. In this specific case, the conical connector support 12, the column 16 and the relative radial legs together form the said floor support structure for the chair.

The mechanism 10 also comprises an element 22 which forms part of the seat (the rest of the seat not being shown for simplicity). From the seat element 22 there downwardly extend four lugs 24, two for each side of the mechanism 10. To the inner side of each lug 24 there are fixed two rotatable rollers 26 between which there is a guide rib 28 forming part of an intermediate element 30. The seat element 22 can consequently slide relative to the intermediate element 30 along the two opposing ribs 28 of this latter, obviously within a determined range defined by two limit stops (not shown for simplicity) applied to the lower face of the seat element 22.

The intermediate element 30 is hinged to the conical connector support 12 by a horizontal pin 32 perpendicular to the advancement direction. The intermediate element 30 comprises a stem 18 for fixing a conventional back-rest (not shown), through holes 20 being provided in the stem 18 for this purpose.

The support 12 is secured to the seat element 22 by two kinematically identical, spaced-apart connecting rods 34, which form said connecting rod means.

Figure 3:
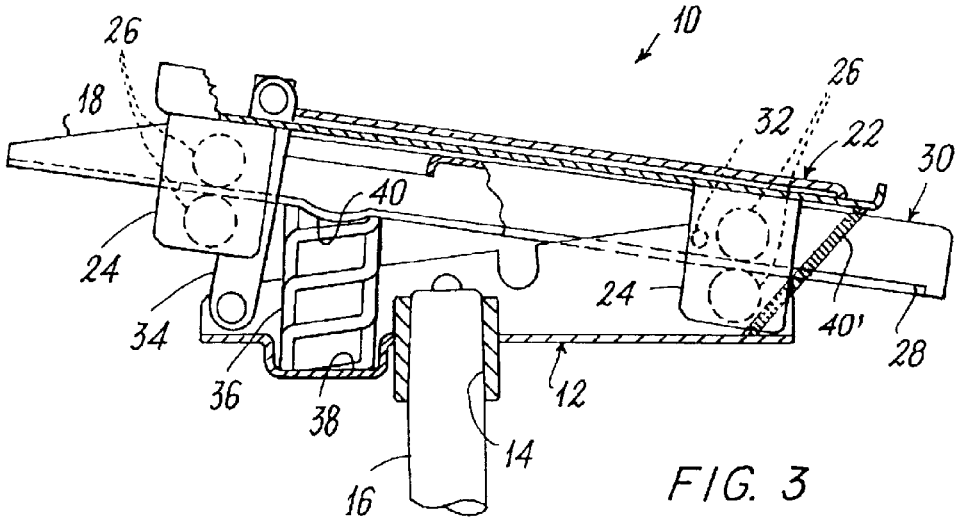
FIG. 3 is a partly sectional side view thereof in the direction of the arrow 3 of FIG. 1, the mechanism being shown in the condition in which the seat is completely withdrawn, the upper part of the chair column also being shown in the figure.
Figure 4:
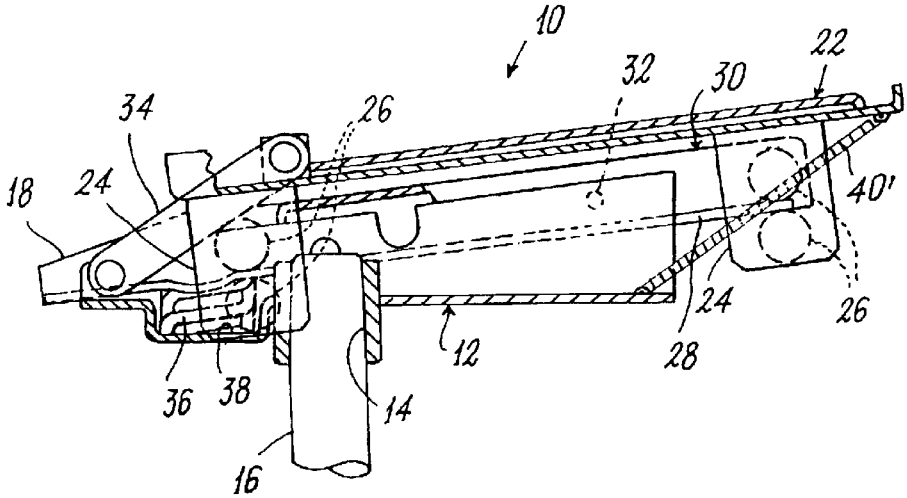
FIG. 4 is similar to FIG. 3, but with the seat in its completely advanced position.

Between the conical connector support 12 and the intermediate element 30 there is disposed a helical spring 36 which, if nobody is seated on the chair, maintains the relative elements (12 and 30) spaced apart, as shown in FIG. 3. In order to maintain the spring 36 in the correct position, there is provided in the conical connector support 12 a recess 38 intended to receive the lower end of the spring 36, the lower surface of the intermediate element 30 comprising a corresponding outward bulge 40 for the same purpose. That configuration of the mechanism 10 which corresponds to the position of maximum advancement of the seat (to attain this the user must be seated) is shown in FIG. 4, and which the user can attain by merely sitting on the chair and pushing with his or her body against the chair back-rest. The user can obviously choose an intermediate position (which, with respect to the situation of FIG. 3, involves a smaller advancement than that shown in FIG. 4).

It should be noted that, having attained the desired seat advancement position, the user has to do nothing other than remain seated.

It should also be noted that as a result of the advancement of the seat element 22, the intermediate element 30 (being rotatably linked to the support 12 by the pin 32) undergoes an anti-clockwise rotation relative to the support 12, this being the same rotation also undergone by the back-rest (being fixed to the stem 18 of the intermediate element 30). Consequently the advancement of the seat element 22 is accompanied by a variation in the angle between the seat element 22 and the support 12 and by an identical variation in the angle between the support 12 and the back-rest, however the angle between the seat element 22 and the back-rest does not vary.

The mechanism 10 can hence be defined as self-balancing. It should also be noted that it is not necessary to provide the mechanism 10 with means for locking it when in the arrangement which it has been made to assume by the action of the user (even though such locking means can be provided if desired).

When the user rises from the seat provided with the mechanism 10, two helical springs 40' which connect the front part of the seat element 22 to the front part of the support 12 (the springs 40' passing through a relative aperture provided in the intermediate element 30) cause the seat to automatically return to its most withdrawn position, so that the entire mechanism 10 returns to the arrangement of FIG. 3. When in this arrangement the springs 40 are already precompressed, and become increasingly compressed as the user advances the seat.

As stated, it is not necessary to provide means within the mechanism 10 to lock it in the arrangement which the user has made it assume by choice. The user could however require the mechanism 10 to maintain a personally preferred arrangement even after he or she has risen from the seat. To satisfy such a requirement the mechanism 10 could comprise the said locking means, operable manually by the user, such as a usual lever locking device which enables the mechanism 10 to be maintained in a determined arrangement.

What is claimed is:

1. A chair comprising:

a support structure for supporting the chair on a floor, said support structure carrying a seat and a backrest;

a mechanism which enables the seat to be advanced relative to the backrest, within a predetermined range;

said mechanism comprising:

a connecting rod means which connects the rear of the seat to the support structure, the connecting rod means operating in a vertical plane parallel to the advancement direction;

an intermediate element disposed between the seat and the support structure, and which at a rear part also carries the backrest;

guide means which enable the seat to be moved in two senses along the advancement direction, relative to the intermediate element;

a cylindrical hinge means with an axis horizontal and perpendicular to the advancement direction, which secures the intermediate element to a front part of the support structure; and a rearward-located first elastic means which tends to withdraw the intermediate element from the support structure.

2. The chair as claimed in claim 1, wherein the connecting rod means comprises a pair of parallel, spaced-apart connecting rods having corresponding end hinges which are coaxial.

3. The chair as claimed in claim 1, wherein the first elastic means comprise a helical spring.

4. The chair as claimed in claim 1, further comprising second elastic means for automatically returning the seat into its most withdrawn position when the chair is unoccupied by a user.

5. The chair as claimed in claim 4, wherein the second elastic means comprise a pair of helical springs.

6. The chair as claimed in claim 1, further comprising locking means for locking the mechanism in a determined arrangement chosen by a user.

7. The chair as claimed in claim 1, further comprising a pair of lugs downwardly extending from the seat for each side of the mechanism.

8. The chair as claimed in claim 7, further comprising a pair of rotatable rollers fixed to the inner side of each lug.

9. The chair as claimed in claim 8, wherein the guide means comprise a guide rib positioned between each pair of rotatable rollers.

* * * * *